US005121790A

United States Patent [19]

Persson

[11] Patent Number: 5,121,790

[45] Date of Patent: Jun. 16, 1992

[54] HEAT EXCHANGER

[75] Inventor: Lars I. Persson, Sölvesborg, Sweden

[73] Assignee: Blackstone Sweden AB, Sweden

[21] Appl. No.: 627,558

[22] PCT Filed: Dec. 21, 1987

[86] PCT No.: PCT/SE87/00618

§ 371 Date: Aug. 10, 1989

§ 102(e) Date: Aug. 10, 1989

[87] PCT Pub. No.: WO88/04761

PCT Pub. Date: Jun. 30, 1988

Related U.S. Application Data

[63] Continuation of Ser. No. 375,003, Aug. 10, 1989, abandoned.

[30] Foreign Application Priority Data

Dec. 19, 1986 [SE] Sweden ..... 8605488

[51] Int. Cl.[5] ..... F28D 7/10; F28F 3/08

[52] U.S. Cl. ..... 165/140; 165/153; 165/167; 165/916

[58] Field of Search ..... 165/140, 153, 166, 167, 165/916

[56] References Cited

U.S. PATENT DOCUMENTS

| | | | |
|---|---|---|---|
| 1,940,964 | 12/1933 | McIntyre | 165/153 |
| 2,511,084 | 6/1950 | Shaw | 165/166 |
| 4,094,358 | 6/1978 | Neveux | 165/154 |
| 4,227,570 | 10/1980 | Crews | 165/140 |
| 4,360,055 | 11/1982 | Frost | 165/167 |
| 4,470,455 | 9/1984 | Sacca | 165/167 |
| 4,501,321 | 2/1985 | Real et al. | 165/153 |
| 4,538,679 | 9/1985 | Hoskins et al. | 165/140 |
| 4,592,414 | 6/1986 | Beasley | 165/167 |
| 4,614,231 | 9/1986 | Proctor et al. | 165/153 |
| 4,665,972 | 5/1987 | Potier | 165/140 |

FOREIGN PATENT DOCUMENTS

| | | | |
|---|---|---|---|
| 0106479 | 4/1984 | European Pat. Off. . | |
| 2322730 | 11/1974 | Fed. Rep. of Germany | 165/916 |
| 2128125 | 10/1972 | France . | |

*Primary Examiner*—John Rivell
*Assistant Examiner*—L. R. Leo
*Attorney, Agent, or Firm*—Barnes, Kisselle, Raisch, Choate, Whittemore & Hulbert

[57] ABSTRACT

A heat exchanger for insertion in a tank which forms part of a vehicle cooler, has a plurality of stacked, flat tubes which consist of a first and a second tube half provided each with one circumferential edge flange, said flanges scalingly engaging with one another and forming a lap joint, and which have at each end a hole to establish communication between the tubes and to form an inlet chamber and an outlet chamber for the fluid to be cooled. The lap joint extends in the direction of the tube thickness in order to form a tube, the inner width of which differs from the outer width by the formula $$b_i = b_y - 4t$$

wherein
$b_i$ = the inner width of the tube,
$b_y$ = the outer width of the tube, and
t = the thickness of the edge flange.

2 Claims, 3 Drawing Sheets

HEAT EXCHANGER

This is a continuation of copending application Ser. No. 07/375,003 filed on Jun. 19, 1989 now abandoned.

The present invention relates to a heat exchanger for insertion in a tank which forms part of a vehicle cooler, said heat exchanger having a plurality of stacked, flat tubes which consist of a first and a second tube half provided each with one circumferential edge flange, said flanges sealingly engaging with one another and forming a lap joint, and which have at each end a hole to establish communication between the tubes and to form an inlet chamber and an outlet chamber for the fluid to be cooled.

Such a heat exchanger may constitute for example a vehicle oil cooler for the cooling of e.g. gear oil and motor oil or hydraulic oil used for driving hydraulically operated devices on the vehicle. As mentioned above, the oil cooler is placed in a tank associated with the normal cooling system of the vehicle, and a mixture of water and glycol flows through as well as around the heat exchanger.

Because of the compactness of presentday vehicles, the available space in the engine compartment tends to diminish. This means that the size of the cooler must be smaller, which in turn means that there is less space available for the oil cooler. As the capacity has to be maintained, new constructions of heat exchangers of this type have become necessary. One such construction is shown in FR 2,428,809 where the heat exchanger consists of a number of flat tubes which are stacked on one another and communicate at their respective ends. At the ends of the tube stack, oil inlets and outlets are provided. Each tube consists of two halves that are joined at the tube periphery by seaming. Another similar construction is shown in DE-OS 3,215,961.

These constructions suffer from the disadvantage that the width of the seam detracts from the inner volume of the tube. As the outer dimensions of the tube are determined by the cooler tank wherein the cooler is to be placed, the space available in the cooler tank will not be optimally utilized, because the seam results in a gap being formed between the wall of the tube and the wall of the cooler tank.

EP-A1 0,106,479 describes a construction wherein each tube in the stack is formed by a strip-shaped tube blank which is bent along its longitudinal central axis and the longitudinal side edges of which are joined after bending in order to form the flat tube. While this construction has enabled an increase of the inner volume of the tube as compared to the above-mentioned constructions, the construction according to EP-A1 0,106,479 requires two end walls to make the construction complete. This increases the cost and also enhances the risk of an untight construction.

The object of the present invention is to eliminate the problems discussed above and to provide a heat exchanger which, with predetermined outer dimensions, yields an increased inner volume and thus a smaller pressure drop across the oil cooler compared to prior art constructions, whereby a higher capacity of heat transmission is obtained, and which is reliable in operation and can be manufactured at low cost.

This object is achieved by means of a heat exchanger of the above-mentioned type, the characteristics of which are defined by the characterizing clause of the appended claim.

A comparison between a heat exchanger according to the invention and a heat exchanger constructed according to the principle of DE-OS 3,215,961 gave the following result:

In the construction according to DE-OS 3,215,961 the manner in which the tube halves are joined to form a flat tube reduces the effective width of the tube by 20%. This in turn deteriorates the cooling performance of the oil cooler by 20% and increases the pressure drop by 40%.

It will thus be evident that the heat exchanger according to the invention is much more efficient than the prior art constructions.

The invention will now be described in more detail, reference being had to the accompanying drawings and the embodiments described below.

Figure 1:
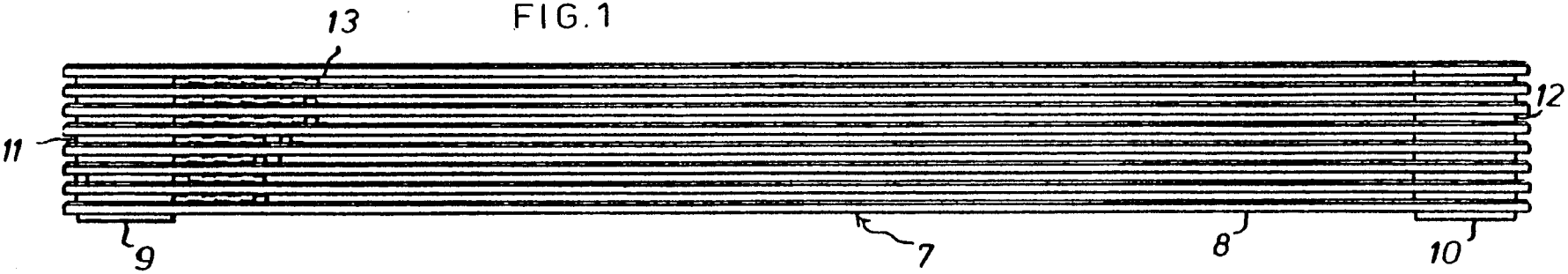
FIG. 1 is a side view of a heat exchanger according to the present invention.
Figure 2:
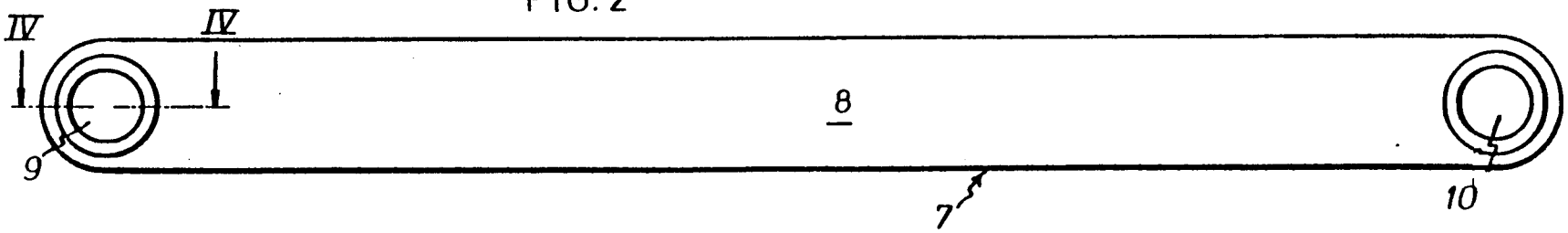
FIG. 2 is a view from below of the heat exchanger in FIG. 1.
Figure 3A:
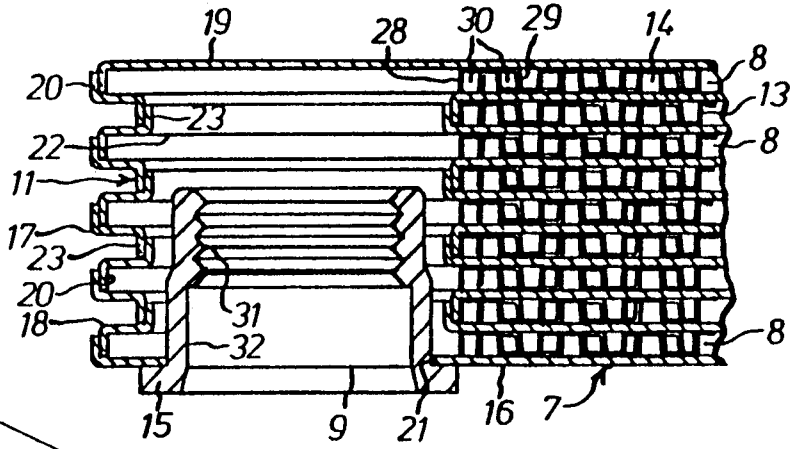
FIG. 3A is a partial section along line IV—IV of the heat exchanger in FIG. 2.
Figure 4:
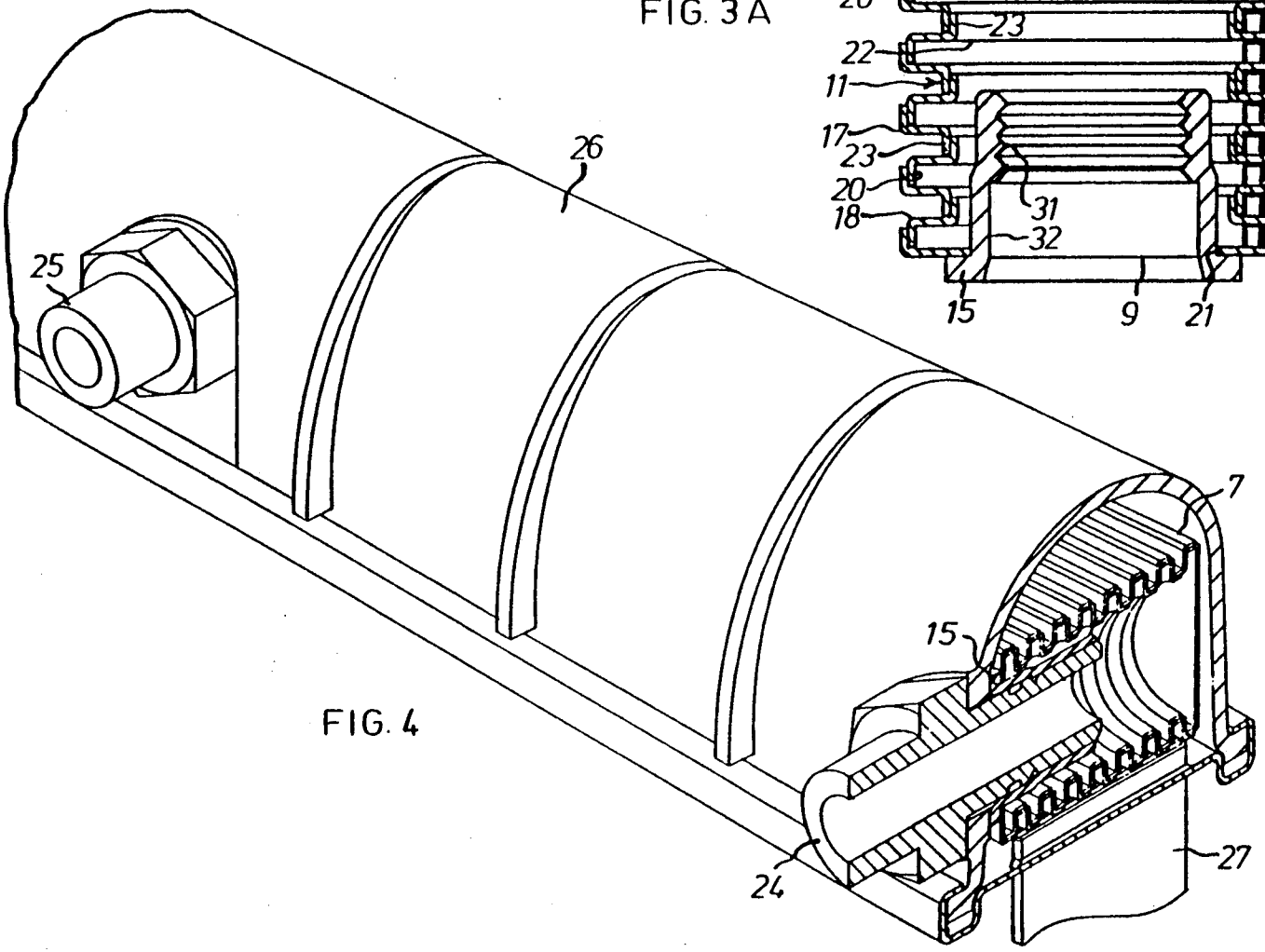
Figure 3B:
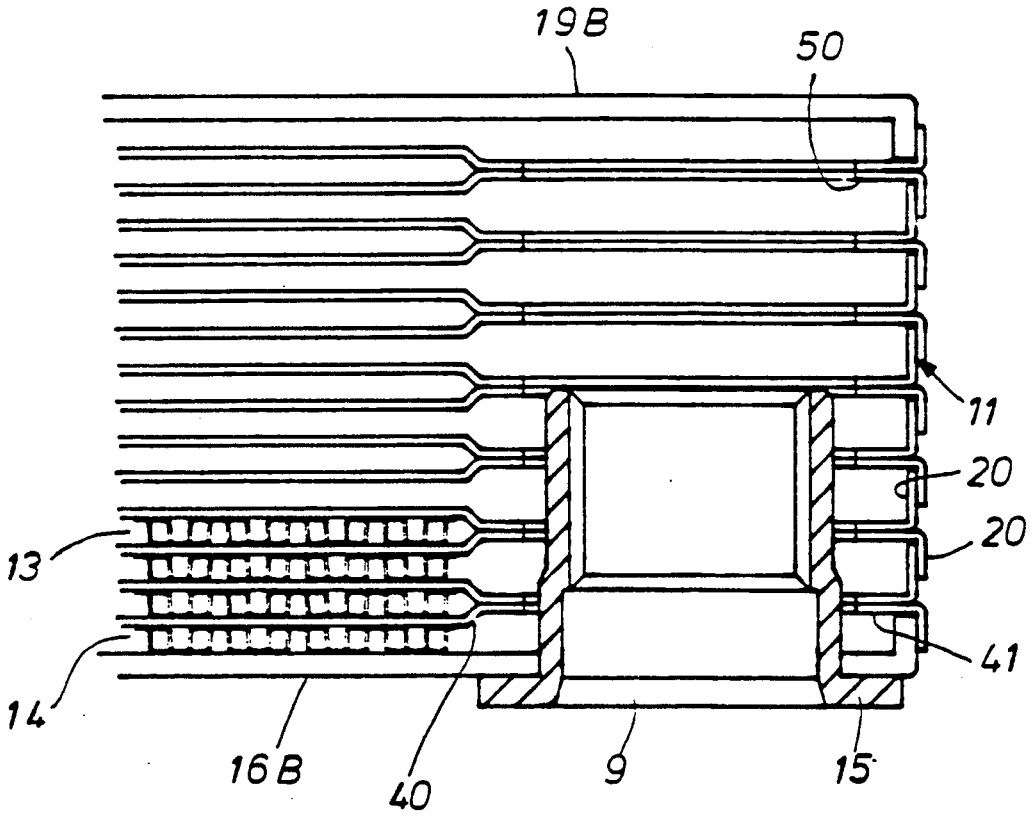

FIG. 3B corresponds to FIG. 3A, but shows another way of connecting the tubes to form a stack; and FIG. 4 is a perspective and part sectional view of a heat exchanger according to FIGS. 1–3A mounted in a vehicle cooler.

FIG. 1 illustrates a heat exchanger 7 according to the invention, which in the following will be referred to as an oil cooler. The oil cooler consists of a number of flat tubes 8 which are stacked on one another. The ends of the tube assembly have an oil inlet 9 with an inlet chamber 11 for the incoming oil which is to be cooled, and an oil outlet 10 with an outlet chamber 12 for cooled oil. The part of the oil cooler that is located between the chambers constitutes the heat exchanger assembly of the cooler. Between each tube 8 in the heat exchanger assembly, outer surface-enlarging means 13 are provided which consist of a corrugated aluminium netting of a special pattern increasing the turbulence in the cooling liquid flowing past the oil cooler. The netting is secured to the tubes 8 by brazing, as will be described in more detail below. The surface-enlarging means can, of course, have other shapes and be made of other materials.

FIG. 2 shows the oil cooler 7 from below. As is seen from this Figure, the tube 8 has rounded ends, the centre of the radius of curvature of the ends coinciding with the centre of the oil inlet 9 and the oil outlet 10, respectively.

FIG. 1 and FIG. 2 show that the stacked flat tubes 8 form an oil cooler of rectangular section.

FIG. 3A is a longitudinal section of one end of the oil cooler 7 and shows the construction of the tubes 8 and the forming of the inlet chamber 11 at the oil inlet 9. It should be mentioned that the outlet chamber 12 at the oil outlet 10 is constructed in the same way as the inlet chamber 11. The tubes 8 consist of two tube halves, one upper and one lower. With the exception of the upper and the lower tube in the tube stack, all the tubes are identical. All the tube halves are provided with an edge flange 20 extending around the entire tube half. The tube half is fabricated from a strip blank which is bent and drawn so as to form the tube half. Furthermore, holes are provided at the ends of all the tube halves, except at the ends of the upper tube half 19 of the uppermost tube. In the lower tube half 16 of the lowermost tube, a hole 21 is provided to form the oil inlet 9. In the other tube halves, holes 22 are provided, the edges of which are shaped to form cylindrical collars 23.

In all the tube halves that are provided with collars 23, the collars are directed opposite to the edge flanges 20. It should be pointed out that corresponding holes and collars are provided at the other end of the tube half. The lower tube halves have inner dimensions that correspond to the outer dimensions of the upper tube half. This means that the upper tube half 18 or 19 can be fitted into the lower tube half 16 or 17 so that the edge flanges 20 overlap. If the tubes 8 thus formed are stacked on one another, such that the collars 23 overlap correspondingly, there is formed a tube stack which at its ends has a chamber 11 and 12, respectively.

Before assembly of the tube halves, an inner surface-enlarging means 14 is placed between the tube halves in the region between the chambers. As mentioned above, outer surface-enlarging means 13 are placed between the tubes in the region between the chambers, before the tubes are stacked. The inner surface-enlarging means have the same construction as the outer surface-enlarging means and consist of a corrugated aluminium netting. The netting comprises a number of mutually offset, corrugated parts 28, 29 between which there are provided slits 30 forcing the oil to be cooled to follow a zigzag-shaped path through the tubes 8. In the Figure, the outer surface-enlarging means 13 has been placed in the same way as the inner surface-enlarging means 14, and since the cooling liquid flows perpendicular to the oil to be cooled, the same zigzag-shaped flow will not be obtained. It would, of course, be possible to place the outer surface-enlarging means in a position displaced through 90° relative to the position shown in the Figure, in order to obtain the same zigzag-shaped flow as through the inner surface-enlarging means 14.

A bush 15 is mounted in the hole 21 in the lower tube half 16 of the lowermost tube. The bush accommodates a coupling nipple which will be described in connection with FIG. 4. The inner part of the bush has a thread 31, and the outer part 32 of the bush accommodates an O-ring (not shown) sealing between the bush and the nipple.

FIG. 3B illustrates a modified embodiment of the oil cooler in FIG. 3A. The two outer tube halves 16B, 19B of the tube assembly have a greater wall thickness in order to make the oil cooler more stable. Furthermore, the tubes are connected in a different way. The area 41 around the holes 50 at the ends of the tube halves is located in a plane outside of the main plane of the tube half. This area is joined to the central part of the tube half by a flange 40. The tubes are interconnected by bringing the tube halves of two adjacent tubes together and joining them in the area 41.

FIG. 4 illustrates a part of a vehicle cooler with a tank 26 and a heat exchanger assembly according to FIG. 3A. The oil cooler 7 according to the invention is inserted in the tank 26, and the Figure shows a nipple 24 screwed into the bush 15 to connect the oil cooler to the outside of the tank 26. Another nipple 25 is screwed into the outlet bush (not shown) of the oil cooler 7.

Thus, the mixture of water and glycol that flows in the tank 26 will flow past the oil cooler 7 and through the outer surface-enlarging means 13 to cool oil supplied through the inlet nipple 24 and discharged through the outlet nipple 25.

The oil cooler shown in FIG. 3A is manufactured in the following manner. The blank used for the manufacturing of the oil cooler is preferably strip-shaped aluminium which is composed of a base material of aluminium and a cladmaterial that consists of aluminium with a lower melting point than the base material and is used as solder. Two tools are required for manufacturing the tube halves, one tool for the upper tube halves and one tool for the lower tube halves. The strip blank is first fed into the manufacturing machine and is cut to form a blank with rounded ends. Then the blank is bent to form the edge flange. Apart from being bent, the material must be drawn to some extent at its ends in order to avoid folds. Then the holes are made, the holes in the tube halves forming the chambers being provided with collars. The surface-enlarging means are then put into the tube halves. Finally, the assembled tubes are stacked on one another, the outer surface-enlarging means having been previously placed between the tubes, before the assembled oil cooler is inserted into a brazing furnace. The bushes in the oil inlet and the oil outlet, respectively, are mounted prior to welding.

Although, in the manufacture described above, aluminium has been used both for the tubes and for the surface-enlarging means, other appropriate materials may, of course, be utilized.

I claim:

1. Heat exchanger for insertion in a tank (26) which forms part of a vehicle cooler, said heat exchanger comprising a heat exchanger assembly which consists of a number of stacked, flat tubes (8), each having an upper tube half (18, 19; 19B) provided with a downwardly bent circumferential edge flange (20) and a lower tube half (16, 17; 16B) provided with an upwardly bent circumferential edge flange (20), said edge flange forming a lap joint and being closely connected with each other; inner-surface-enlarging means (14) placed in the heat exchanger assembly between the tube halves connected with each other; outer surface-enlarging means (13) placed between said tubes; a fluid inlet (9) formed of a hole (21) in one end of the lower tube half (16) of the lowermost tube; a fluid outlet (10) formed of a hole in another end of the lower tube half of the lowermost tube; an inlet distribution duct for distributing fluid between the stacked tubes; and an outlet collecting duct for collecting the fluid from the stacked tubes, said inlet distribution and outlet collecting ducts being formed of holes (22; 50) in each end of the tubes, said holes being arranged opposite each other, and edges (23; 41) of neighboring holes being closely connected with each other, characterized by a bush (15) inserted into the inlet distribution duct and the outlet collecting duct, respectively, and having a first end with an annular flange connected to the outside of the lower tube half (16) of the lowermost tube and adapted to surround a corresponding hole in the tank, and a second end positioned in the inlet distribution duct and the outlet collecting duct, respectively, and coupling nipples (24, 25), each having a tubular part which is inserted in the respective bush through a corresponding hole in the tank after insertion of the heat exchanger in the tank, such that both the second end of said bush and the tubular part of said coupling nipple are positioned within the inlet, distribution duct and outlet collecting duct, respectively, a coupling part positioned outside the tank after insertion of the tubular part in the bush and an annular flange interconnecting said tubular part and said coupling part, said annular flange on said coupling nipple surrounding said hole on the outside of the tank after insertion of said tubular part in said bush; and interengaging means between said bush and its respective nipple, said flange on the bush and said corresponding flange on the coupling nipple together providing a seal at the hole in the tank.

2. The heat exchanger set forth in claim 1 wherein said interengaging means comprises threads.

* * * * *